US009663337B2

(12) United States Patent
Kuck et al.

(10) Patent No.: US 9,663,337 B2
(45) Date of Patent: May 30, 2017

(54) CARRIAGE ASSEMBLY FOR MATERIALS HANDLING VEHICLE AND METHOD FOR MAKING SAME

(71) Applicant: Crown Equipment Corporation, New Bremen, OH (US)

(72) Inventors: Jay L. Kuck, Saint Marys, OH (US); Steven E. Koenig, New Bremen, OH (US); Patrick H. Wenning, Sidney, OH (US)

(73) Assignee: Crown Equipment Corporation, New Bremen, OH (US)

( * ) Notice: Subject to any disclaimer, the term of this patent is extended or adjusted under 35 U.S.C. 154(b) by 0 days.

(21) Appl. No.: 14/747,209

(22) Filed: Jun. 23, 2015

(65) Prior Publication Data

US 2015/0375976 A1 Dec. 31, 2015

Related U.S. Application Data

(60) Provisional application No. 62/017,328, filed on Jun. 26, 2014.

(51) Int. Cl.
*B66F 9/075* (2006.01)
*B66F 9/12* (2006.01)

(52) U.S. Cl.
CPC ..... *B66F 9/075* (2013.01); *B66F 9/12* (2013.01)

(58) Field of Classification Search
CPC ..... B66F 9/12; B66F 9/075
(Continued)

(56) References Cited

U.S. PATENT DOCUMENTS 2,851,182 A 9/1958 Gehring
3,356,241 A 12/1967 Varilek
(Continued)

FOREIGN PATENT DOCUMENTS

DE 3432207 3/1985
DE 102005007106 A1 10/2005
(Continued)

OTHER PUBLICATIONS

Faymann, L.; International Search Report and Written Opinion of the International Searching Authority; International Application No. PCT/US2015/037128; Aug. 31, 2015; European Patent Office; Rijswijk, Netherlands.
(Continued)

*Primary Examiner* — Michael Riegelman
(74) *Attorney, Agent, or Firm* — Stevens & Showalter LLP

(57) ABSTRACT

A method is provided for manufacturing a fork carriage comprising: providing a fork-supporting bar having first and second fork-receiving hooks, wherein the second hook is of a larger size than the first hook; based on a size of one or more forks desired to be mounted on the fork-supporting bar, positioning the bar such that one of the first and second fork-receiving hooks corresponding to the size of the one or more forks is located outwardly to receive the one or more forks on the one fork-receiving hook; and coupling a reinforcement bar to a side of the fork-supporting bar opposite the side near the one fork-receiving hook. A carriage assembly comprising a fork carriage including an upper member comprising a fork-supporting bar having an outer fork-receiving hook and a reinforcement bar is also provided.

13 Claims, 8 Drawing Sheets

(58) Field of Classification Search
USPC ..... 187/237
See application file for complete search history.

(56) References Cited

U.S. PATENT DOCUMENTS

| | | | | |
|---|---|---|---|---|
| 3,424,328 | A | 1/1969 | Gideonsen et al. | |
| 3,819,078 | A | 6/1974 | Walsh | |
| 3,974,927 | A | 8/1976 | Schuster | |
| 4,065,015 | A * | 12/1977 | Radakovich | B66F 9/12 414/785 |
| 4,125,199 | A | 11/1978 | Abels et al. | |
| 4,173,425 | A | 11/1979 | Dixon et al. | |
| 4,355,947 | A * | 10/1982 | Wiblin | B66F 9/12 403/408.1 |
| 4,392,773 | A | 7/1983 | Johannson | |
| 4,406,575 | A | 9/1983 | Gaibler | |
| 4,505,635 | A | 3/1985 | Shinoda et al. | |
| 4,607,997 | A | 8/1986 | Asano | |
| 4,657,471 | A | 4/1987 | Shinoda et al. | |
| 4,961,681 | A | 10/1990 | Threatt | |
| 5,052,881 | A | 10/1991 | Keffeler et al. | |
| 5,217,343 | A | 6/1993 | Bostad et al. | |
| 5,338,148 | A | 8/1994 | Rönnblom | |
| 5,368,435 | A * | 11/1994 | Bostad | B66F 9/148 414/667 |
| 5,707,201 | A | 1/1998 | Hamlik | |
| 5,807,060 | A | 9/1998 | Hamlik | |
| 5,897,288 | A | 4/1999 | Green | |
| 5,913,654 | A | 6/1999 | Kaup | |
| 6,279,686 | B1 | 8/2001 | Kaup | |
| 6,390,763 | B1 * | 5/2002 | Prentice | B66F 9/148 414/659 |
| 6,881,023 | B1 * | 4/2005 | Sullivan | B66F 9/18 187/237 |
| 7,380,826 | B2 * | 6/2008 | Schonauer | B66F 9/14 280/762 |
| 7,588,409 | B2 | 9/2009 | Foroni | |
| 7,909,563 | B2 | 3/2011 | Prentice | |
| 7,993,094 | B2 | 8/2011 | Tygard | |
| 8,353,388 | B2 * | 1/2013 | Rice | B66F 9/07559 177/139 |
| 8,403,618 | B2 | 3/2013 | Prentice et al. | |
| 2003/0156935 | A1 | 8/2003 | Mondani et al. | |
| 2006/0104783 | A1 | 5/2006 | Schroder | |
| 2006/0151250 | A1 * | 7/2006 | Tyree | B66F 9/142 187/237 |
| 2008/0152471 | A1 | 6/2008 | Polvilampi | |

FOREIGN PATENT DOCUMENTS

| | | | |
|---|---|---|---|
| DE | 202010016367 | U1 | 3/2011 |
| DE | 102010052757 | A1 | 5/2012 |
| DE | 102012109295 | A1 | 4/2014 |
| EP | 0774441 | A2 | 5/1997 |
| EP | 0785167 | A1 | 7/1997 |
| EP | 1024109 | A2 | 8/2000 |
| EP | 1160191 | A2 | 12/2001 |
| EP | 1711428 | B1 | 3/2010 |
| EP | 2444362 | A1 | 4/2012 |
| EP | 2447203 | A1 | 5/2012 |
| EP | 2712839 | A2 | 4/2014 |
| EP | 2614028 | B1 | 2/2015 |
| GB | 2266700 | A | 11/1993 |
| GB | 2479327 | A | 10/2011 |
| WO | 03070617 | A1 | 8/2003 |
| WO | 2006037841 | A1 | 4/2006 |

OTHER PUBLICATIONS

Wittmann-Regis, Agnès; International Preliminary Report on Patentability and Written Opinion of the International Searching Authority; International Application No. PCT/US2015/037128; Jan. 5, 2017; The International Bureau of WIPO; Geneva, Switzerland.

* cited by examiner

CARRIAGE ASSEMBLY FOR MATERIALS HANDLING VEHICLE AND METHOD FOR MAKING SAME

RELATED APPLICATIONS

This application claims the benefit of U.S. Provisional Application No. 62/017,328, filed Jun. 26, 2014, which is herein incorporated by reference in its entirety.

FIELD OF THE INVENTION

The present invention relates to a carriage assembly to be movably coupled to a mast assembly of a materials handling vehicle comprising a lifting carriage and a fork carriage mounted to the lifting carriage and capable of lateral movement relative to the lifting carriage.

BACKGROUND OF THE INVENTION

Materials handling vehicles are known comprising a carriage assembly movably mounted to a mast assembly of a materials handling vehicle comprising a lifting carriage and a fork carriage mounted on the lifting carriage for lateral movement relative to the lifting carriage. A fork-supporting member of the fork carriage may be formed having a fork-receiving hook. It is known to form the fork-supporting member having the fork-receiving hook using a hot rolling process involving a specifically designed hot rolling die. The cost of the die is expensive and the cost of manufacturing the hot rolled material from which a plurality of the fork-supporting members are formed decreases with volume.

SUMMARY OF THE INVENTION

In accordance with a first aspect of the present invention, a method is provided for manufacturing a fork carriage comprising: providing a fork-supporting bar having first and second fork-receiving hooks, wherein the second fork-receiving hook is of a larger size than the first fork-receiving hook; based on a size of one or more forks desired to be mounted on the fork-supporting bar, positioning the fork-supporting bar such that one of the first and second fork-receiving hooks corresponding to the size of the one or more forks is located outwardly to receive the one or more forks on the one fork-receiving hook; and coupling a reinforcement bar to a first side of the fork-supporting bar opposite a second side near the one fork-receiving hook.

The method may further comprise selecting a size of the reinforcement bar based on a desired amount of weight to be supported by the one or more forks.

The fork-supporting bar may comprise an H-shaped bar.

Coupling the reinforcement bar to the fork-supporting bar may comprise welding the reinforcement bar to the first side of the fork-supporting bar opposite the second side near the one fork-receiving hook.

The reinforcement bar may be vertically offset relative to the fork-supporting bar such that upper and lower surfaces of the reinforcement bar are vertically offset relative to upper and lower surfaces of the fork-supporting bar.

Coupling the reinforcement bar to the fork-supporting bar may comprise making a first fillet weld between a side surface of the reinforcement bar and an upper corner of the fork-supporting bar. Coupling may further comprise making a second fillet weld between a bottom surface of the reinforcement bar and a lower side surface and a lower corner of the fork-supporting bar.

The reinforcement bar may span generally the entire length of the fork-supporting bar.

The method may further comprise machining notches in the one fork-receiving hook.

In accordance with a second aspect of the present invention, a carriage assembly is provided, which is adapted to be movably coupled to a mast assembly of a materials handling vehicle. The carriage assembly may comprise: a lifting carriage comprising a lifting carriage upper member including structure for laterally shifting a fork carriage; and the fork carriage mounted on the lifting carriage upper member. The fork carriage may comprise fork carriage upper and lower members and fork carriage first and second side members, wherein the upper and lower members may be coupled to the fork carriage first and second side members. The upper member may comprise a fork-supporting bar having an outer fork-receiving hook and a reinforcement bar mounted to a first side of the fork-supporting bar opposite a second side near the fork-receiving hook.

Notches may be provided in the outer fork-receiving hook.

The reinforcement bar may be vertically offset relative to the fork-supporting bar such that upper and lower surfaces of the reinforcement bar are vertically offset relative to upper and lower surfaces of the fork-supporting bar.

The reinforcement bar may be coupled to the fork-supporting bar via a first fillet weld located between a side surface of the reinforcement bar and an upper corner of the fork-supporting bar.

The reinforcement bar may be further coupled to the fork-supporting bar via a second fillet weld located between a bottom surface of the reinforcement bar and a lower side surface and a lower corner of the fork-supporting bar.

The reinforcement bar may span generally an entire length of the fork-supporting bar.

The reinforcement bar may have a vertical height greater than a vertical height of the fork-supporting bar.

The fork-supporting bar may comprise an H-shaped bar.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 4A:
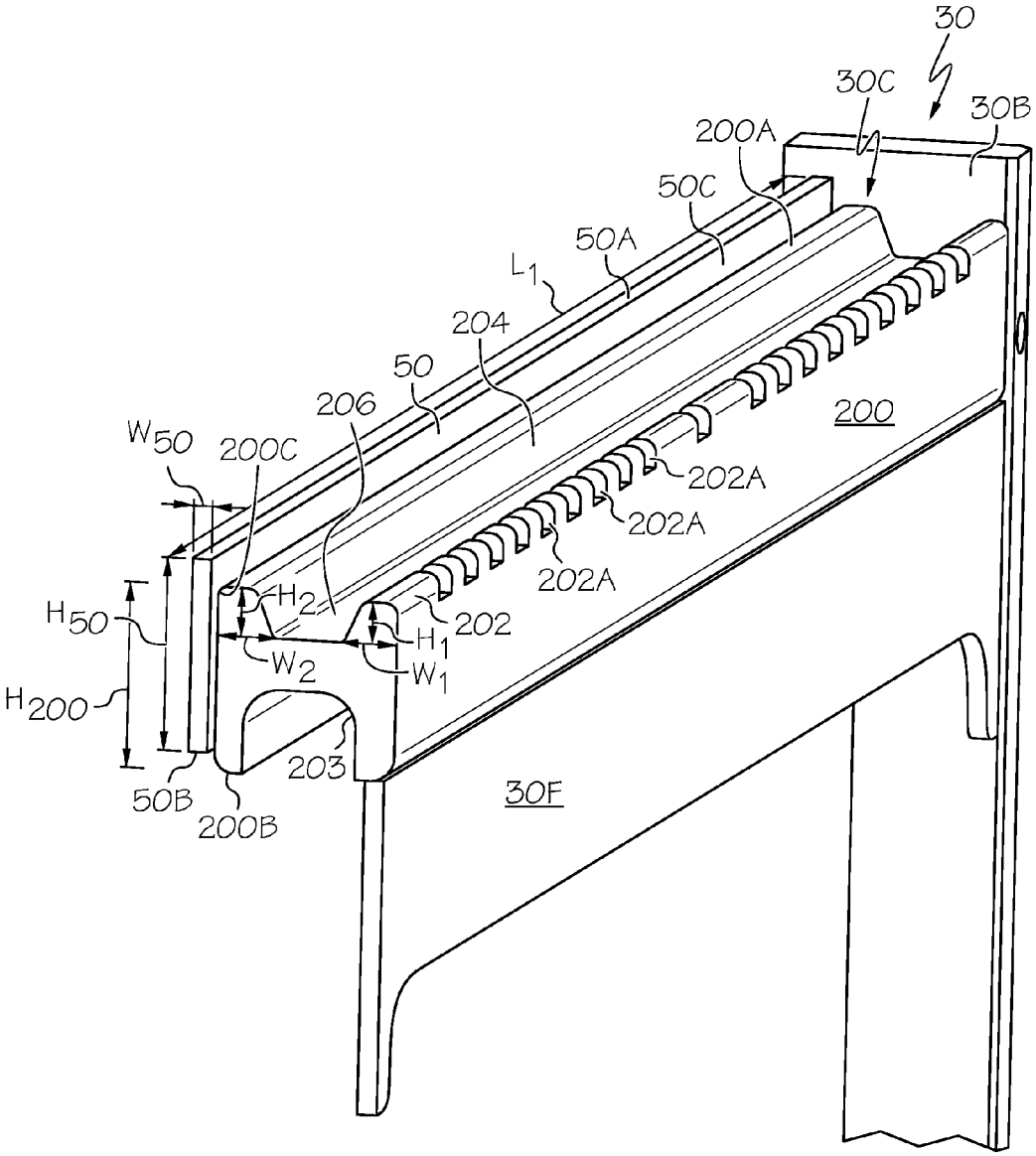
FIGS. 4A, 4B, and 4C are perspective views of portions of fork carriages and corresponding upper members of first, second, and third embodiments of the present invention.
Figure 4B:
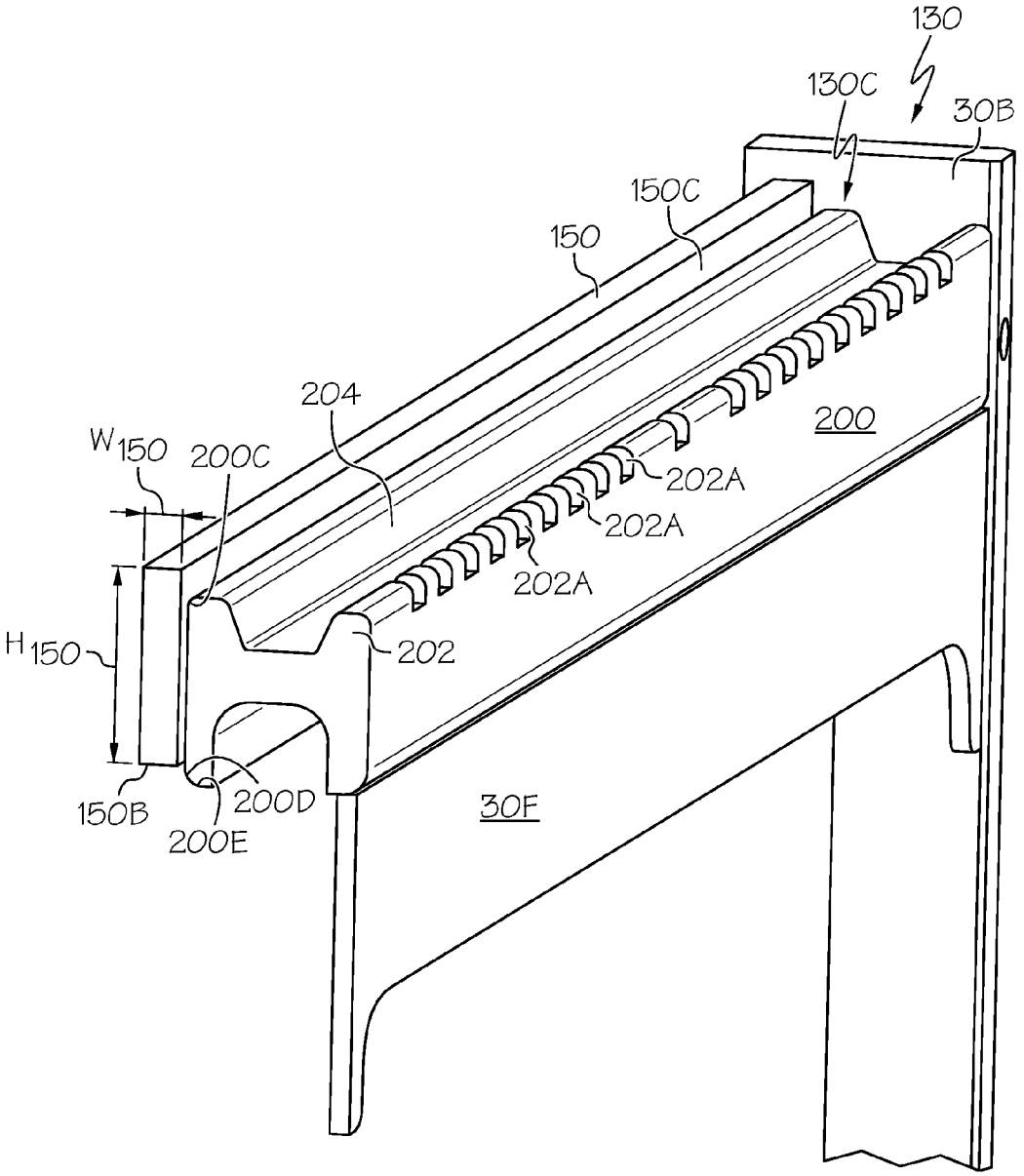
Figure 4C:
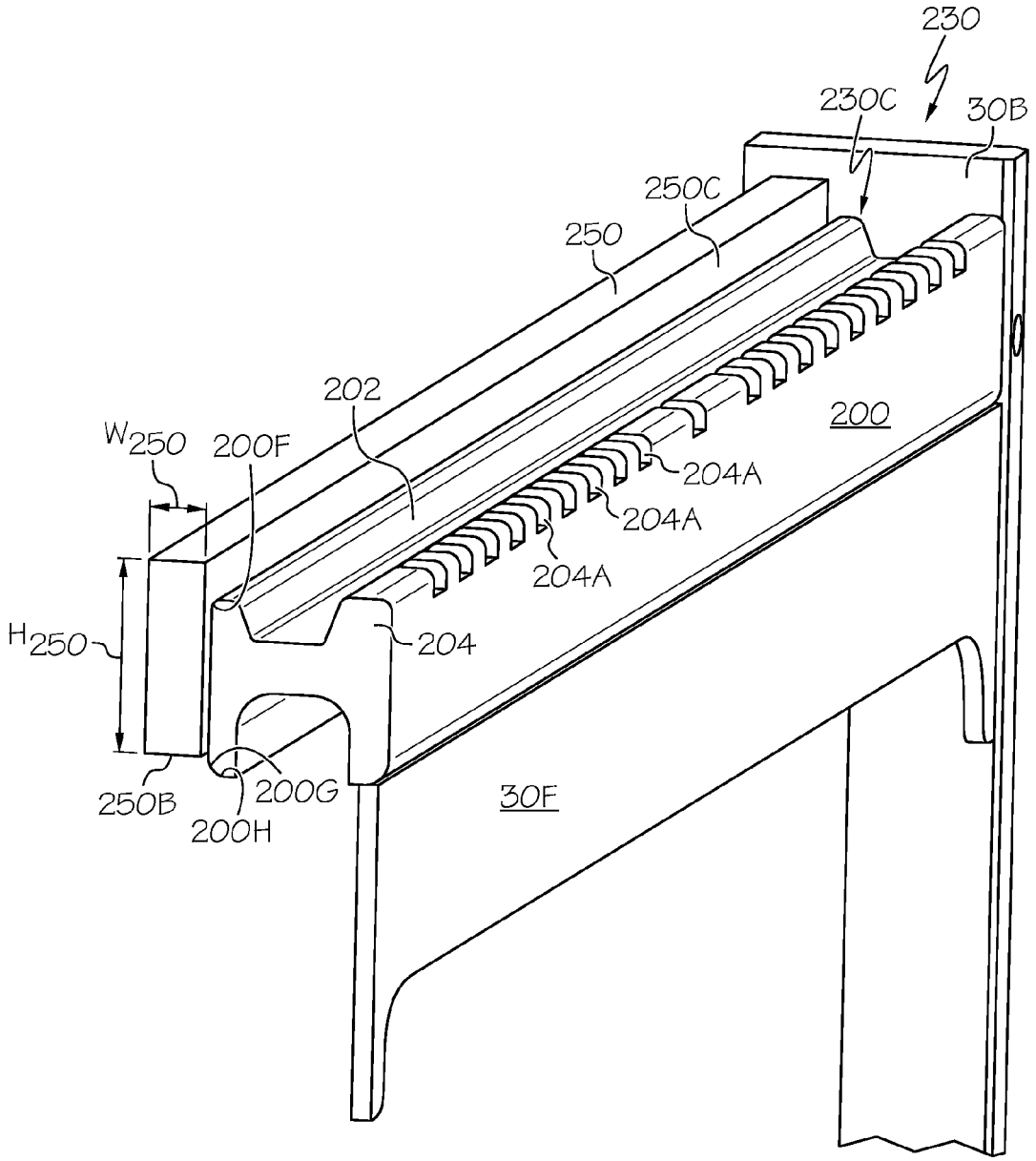
Figure 5:
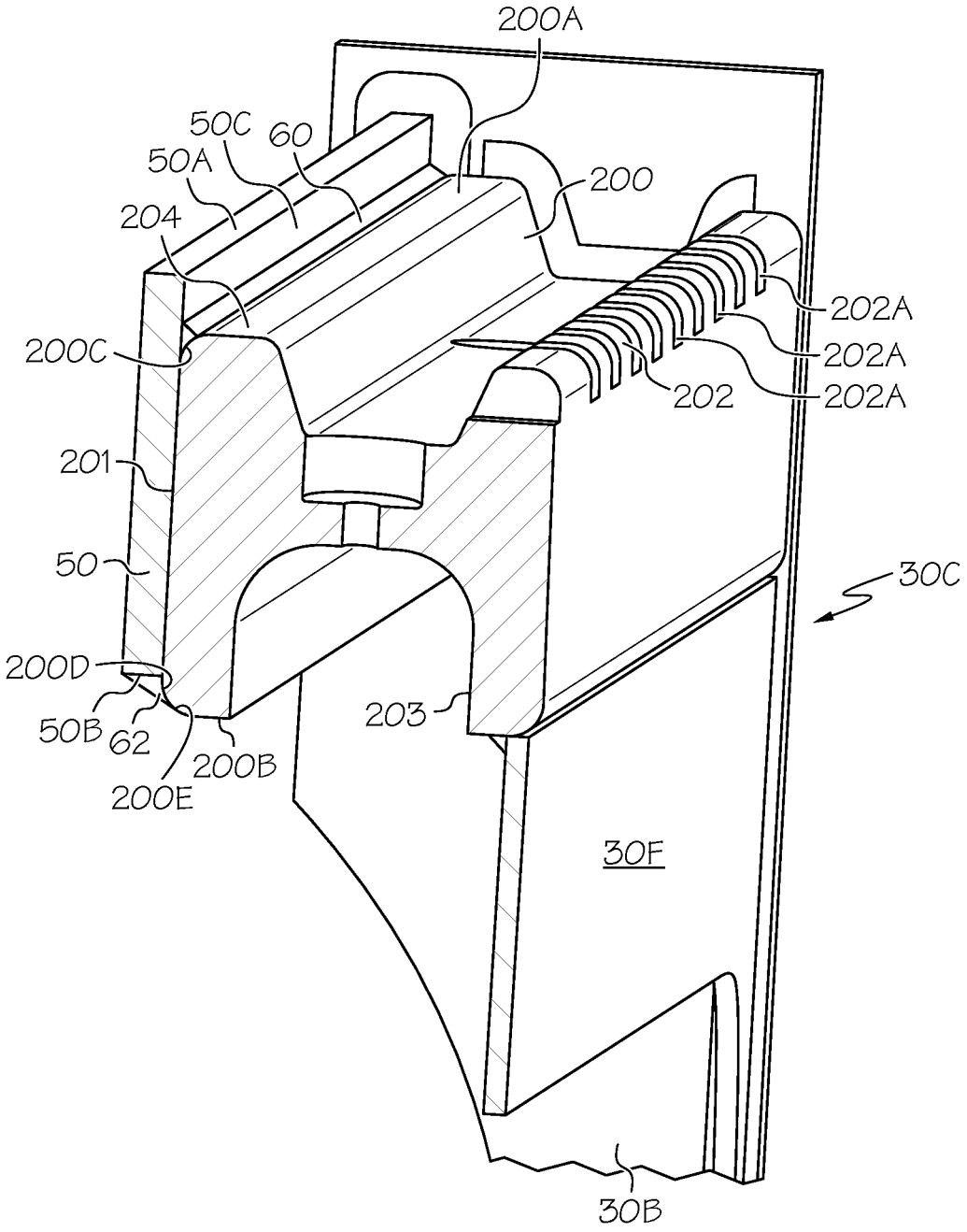
FIG. 5 is a view partially in cross section of a portion of a fork carriage upper member constructed in accordance with the first embodiment of the present invention.
Figure 6:
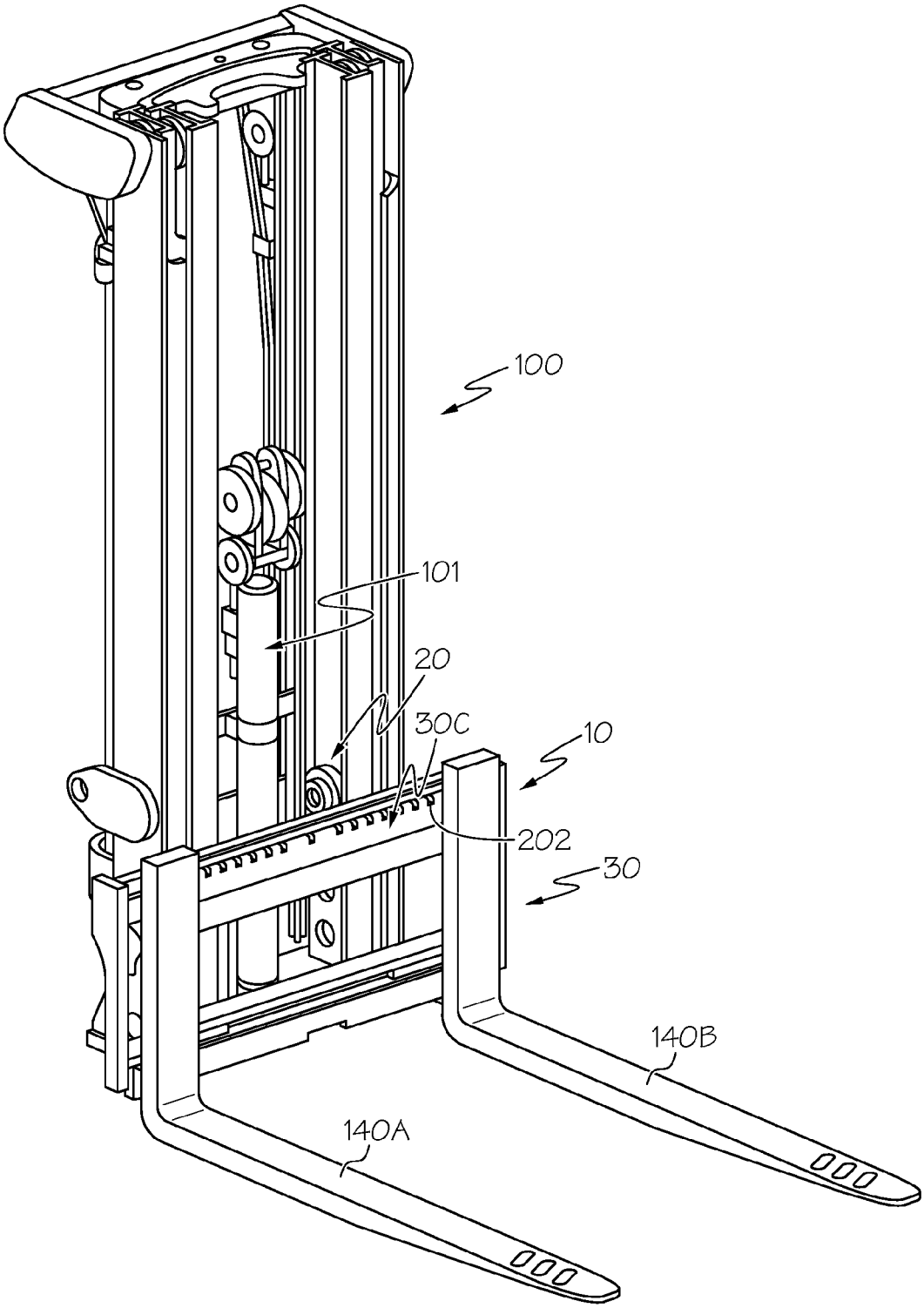
FIG. 6 is a view of a materials handling vehicle including the carriage assembly of FIG. 1.

With reference to FIGS. 1-6, a carriage assembly 10 adapted to move vertically up and down along a mast assembly 100 of a materials handling vehicle is illustrated. As seen in FIG. 6, the carriage assembly 10 comprises a lifting carriage 20 coupled to the mast assembly 100 for reciprocal, vertical movement along the mast assembly 100 via a primary cylinder and ram assembly 101 mounted to the mast assembly 100 and a chain (not shown) coupled between the lifting carriage 20 and the primary cylinder and ram assembly 101. A fork carriage 30 is mounted to the lifting carriage 20 for lateral movement relative to the lifting carriage 20 and for vertical movement with the lifting carriage 20. First and second forks 140A and 140B are mounted onto the fork carriage 30 so as to move with the fork carriage 30.

Figure 1:
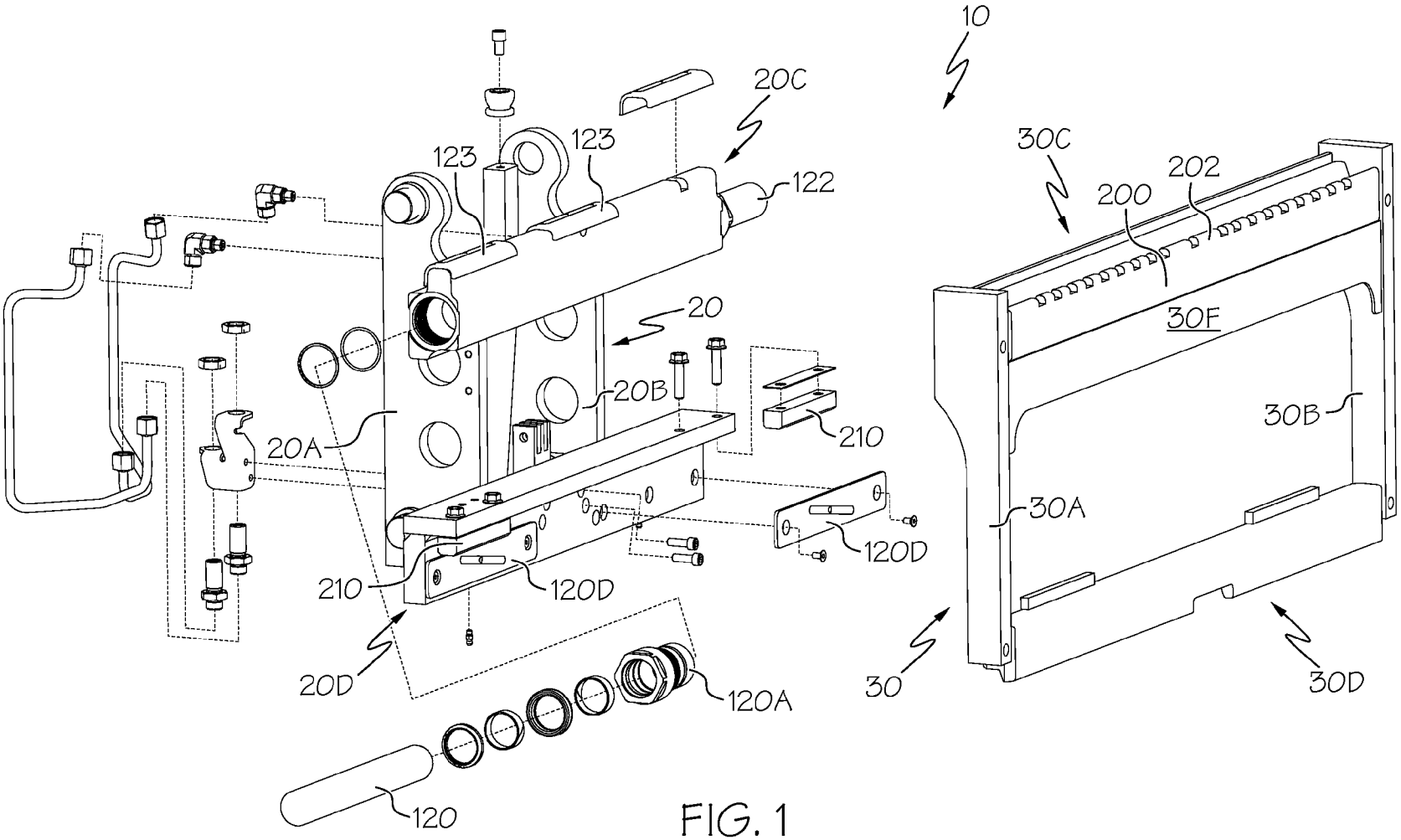
FIG. 1 is an exploded view of the carriage assembly of the present invention.
Figure 2:
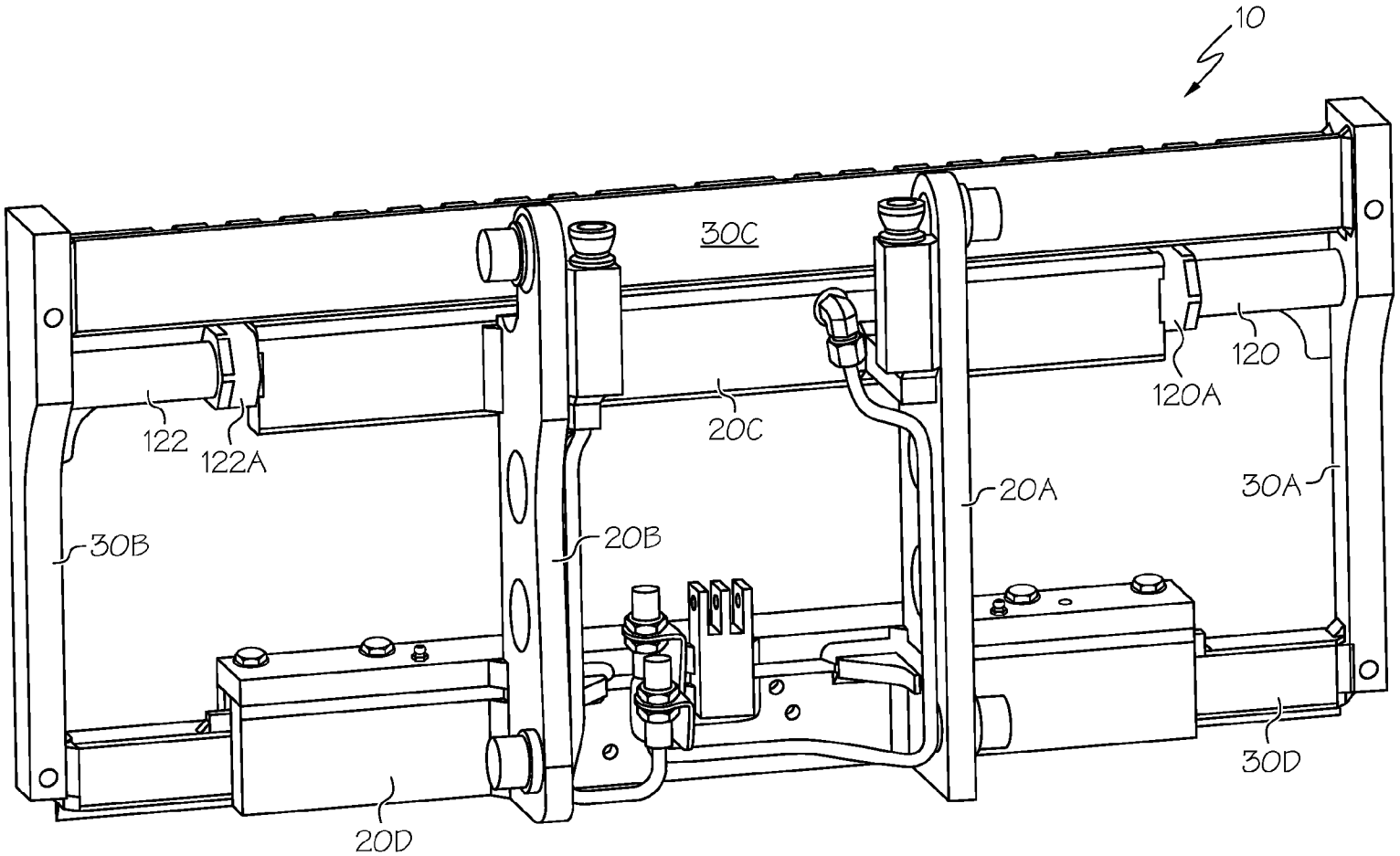
FIG. 2 is a rear view of the carriage assembly of FIG. 1.

With reference to FIGS. 1 and 2, the lifting carriage 20 comprises first and second vertical members 20A, 20B and upper and lower support members 20C and 20D, all of which are coupled together via welding so as to move as a unit. The lifting carriage upper member 20C comprises first and second separate internal cylinders (not labeled) receiving first and second rams 120 and 122. End caps 120A, 122A are provided at opposing ends of the upper member 20C to provide seals between the first and second internal cavities and the first and second rams 120 and 122. Hydraulic fluid is separately provided to the first and second internal cylinders to effect movement of the rams 120 and 122 and, hence, the fork carriage 30. Polymeric, low-friction, low-wear linear bearings 123 are provided on an upper surface of the upper support member 20C, as shown in FIG. 1.

Figure 3:
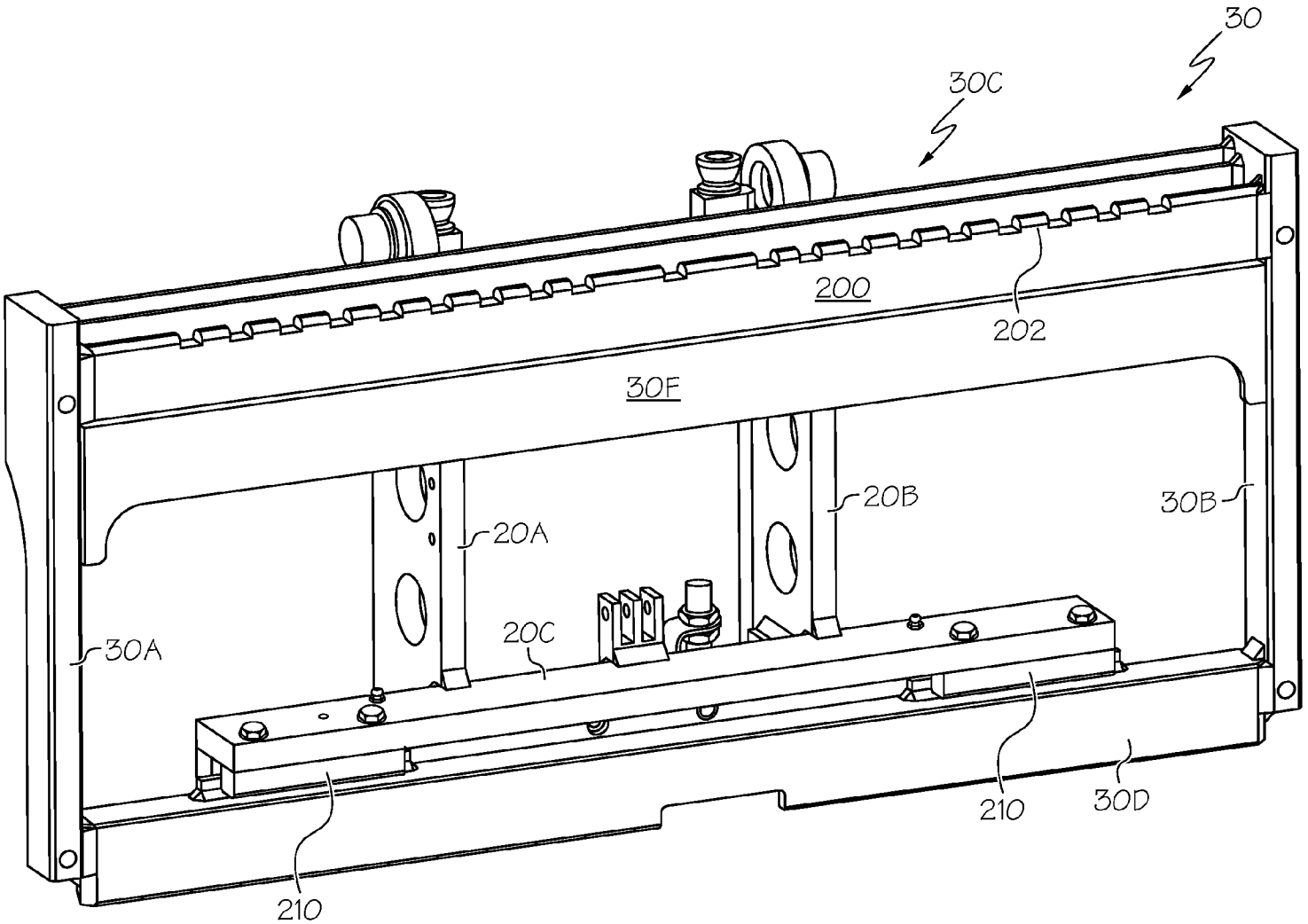
FIG. 3 is a front view of the carriage assembly of FIG. 1.

The fork carriage 30, constructed in accordance with a first embodiment of the present invention, comprises first and second vertical members 30A, 30B and upper and lower generally horizontal members 30C, 30D, as seen in FIGS. 1 and 3. The first, second, and upper and lower members 30A, 30B, 30C and 30D are coupled together via welding to form an integral unit.

The fork carriage upper member 30C, constructed in accordance with a first embodiment of the present invention, comprises a fork-supporting bar, which, in the embodiment illustrated in FIGS. 1-6, comprises an H-shaped bar 200. While not illustrated, it is contemplated that the fork-supporting bar may have a shape other than an H-shape. The H-shaped bar 200 is a hot-rolled section. A specifically designed hot rolling die (not shown) is used in manufacturing the H-shaped bar 200, the die for which is expensive to design and produce. With reference to FIGS. 4A-C and 5, the H-shaped bar 200 comprises first and second fork-receiving hooks 202 and 204. The second fork-receiving hook 204 is sized larger than the first fork-receiving hook 202 such that the second fork-receiving hook 204 is capable of supporting forks that are larger, e.g., Class 3 forks, than those forks adapted to be supported on the first fork-receiving hook 202, e.g., Class 2 forks. For example, as illustrated in FIG. 4A, the first fork-receiving hook 202 may have a height $H_1$ extending above a recess 206 of about 13 mm and a maximum width $W_1$=16 mm. The second fork-receiving hook 204 may have a height $H_2$ extending above the recess 206 equal to about 16 mm and a maximum width $W_2$=21 mm. In an alternative embodiment, the first fork-receiving hook 202 may have a maximum width $W_1$=20.4 mm, and the second fork-receiving hook 204 may have a maximum width $W_2$–27.0, with a corresponding width at the tip of each fork-receiving hook 202 and 204 of 16 mm and 21.5 mm, respectively.

In accordance with a first embodiment of the present invention, the fork carriage 30 and its upper member 30C are constructed such that the first fork-receiving hook 202 is positioned outwardly away from the mast assembly 100, as shown in FIG. 6, so as to allow the forks 140A and 140B to be mounted on the first fork-receiving hook 202. The forks 140A and 140B may comprise Class 2 forks having a fork load supporting capacity ranging from about 3000 pounds to about 5500 pounds (ISO Class 2 1000-2500 kg). With reference to FIGS. 4A and 5, a reinforcement bar 50 is welded to the H-shaped bar 200 and positioned adjacent to a side 201 of the H-shaped bar near the second fork-receiving hook 204 to provide structural reinforcement to the H-shaped bar 200. In the illustrated embodiment, the reinforcement bar 50 is vertically offset relative to the H-shaped bar 200 such that reinforcement bar upper and lower surfaces 50A and 50B, respectively, are vertically offset relative to upper and lower surfaces 200A and 200B, respectively, of the H-shaped bar 200, as best seen in FIG. 5.

Because the reinforcement bar 50 is vertically offset relative to the H-shaped bar 200, a first fillet weld 60 (shown in FIG. 5 but not in FIG. 4A) can be formed between a side surface 50C of the reinforcement bar 50 and an upper corner 200C of the H-shaped bar 200. Further, a second fillet weld 62 (shown in FIG. 5 but not in FIG. 4A) can be formed between the bottom surface 50B of the reinforcement bar 50 and a lower side surface 200D and/or a lower corner 200E of the H-shaped bar 200. It is believed that the first and second fillet welds 60 and 62 provide enhanced structural integrity, rigidity and strength to the fork carriage upper member 30C. The H-shaped bar 200 is also welded to the fork carriage first and second members 30A and 30B via fillet and groove welds.

In the illustrated embodiment as shown in FIG. 4A, the reinforcement bar 50 has a height $H_{50}$ equal to about 63 mm and a width $W_{50}$ equal to about 6 mm. The reinforcement bar 50 spans generally the entire length $L_1$ of the H-shaped bar 200, wherein $L_1$=about 900 mm in the illustrated embodiment. The height $H_{200}$ of the H-shaped bar 200, when measured near the second fork-receiving hook 204, is equal to 60.5 mm in the illustrated embodiment. Hence, the height $H_{50}$ of the reinforcement bar 50 is greater than the height $H_{200}$ of the H-shaped bar 200 when measured near the second fork-receiving hook 204, thereby providing increased structural rigidity and strength to the fork carriage upper member 30C.

Further during manufacturing, a plurality of notches 202A are machined into the first fork-receiving hook 202 to receiving corresponding mating structure (not shown) on the forks 140A and 140B.

As seen in FIGS. 1, 4A-4C, and 5, a protection shield 30F is welded to the H-shaped bar 200 and the fork carriage first and second side members 30A and 30B so as to provide protection for the rams 120 and 122 of the lifting carriage upper member 20C, which rams 120 and 122 are positioned behind the protection shield 30F, and to increase the overall strength of the fork carriage upper member 30C. The fork carriage 30 and its upper member 30C of the first embodiment are designed to support up to about 4500 pounds.

The fork carriage 30 is mounted to the lifting carriage 20 by positioning the fork carriage upper member 30C over the lifting carriage upper support member 20C such that an inner cavity 203 of the H-shaped bar 200 is fitted over an upper surface of the support member 20C including the linear bearings 123, as shown in FIGS. 1 and 4A. It is noted that the lifting carriage lower support member 20D is provided with first and second polymeric, low-friction, low-wear linear bearings 120D, which are engaged by the fork carriage lower member 30D. As shown in FIGS. 1 and 3, securement blocks 210, made from steel, are bolted to the lower support member 20D after the fork carriage 30 has been mounted to the lifting carriage 20 to prevent the fork carriage 30 from coming off the lifting carriage 20.

When the first internal cylinder within the lifting carriage upper support member 20C is supplied with hydraulic fluid, the first ram 120 is moved outwardly, causing the fork carriage 30 to move laterally to the right in FIG. 2. When the second internal cylinder within the lifting carriage upper support member 20C is supplied with hydraulic fluid, the second ram 122 is moved outwardly, causing the fork carriage 30 to move laterally to the left in FIG. 2. When fluid is provided to the first cylinder, fluid is not provided to the second cylinder and vice versa. As noted above, the H-shaped bar 200 is a hot-rolled section, which is expensive to manufacture. In order to reduce the expense of designing and producing two separate hot rolling dies to produce two separate fork-supporting bars with different profiles, the H-shaped bar 200 has been designed with the first and second fork-receiving hooks 202 and 204 to allow the H-shaped bar 200 to be used in the manufacture of separate fork carriages for supporting forks of different sizes and/or different maximum loads.

A fork carriage 130 constructed in accordance with a second embodiment of the present invention is illustrated in FIG. 4B and comprises a fork carriage upper member 130C. The fork carriage 130 further includes first and second vertical members 30A and 30B and a lower member 30D, which are substantially the same as like elements used in the construction of the fork carriage 30 illustrated in FIG. 1.

The fork carriage upper member 130C, constructed in accordance with the second embodiment of the present invention, comprises a fork-supporting bar, which, in the embodiment illustrated in FIG. 4B, comprises the same H-shaped bar 200 as used in the fork carriage upper member 30C in accordance with a first embodiment shown in FIG. 4A. The fork carriage 130 and its upper member 130C are constructed such that the first fork-receiving hook 202 is positioned outwardly away from the mast assembly 100 similar to a first embodiment of the present invention shown in FIG. 6, to allow the forks 140A and 140B, e.g., Class 2 forks, to be mounted on the first fork-receiving hook 202. Hence, the same size forks 140A and 140B are adapted to be mounted on the fork carriage upper members 30C and 130C of the first and second embodiments. A reinforcement bar 150 is welded to the H-shaped bar 200 and positioned adjacent to a side of the H-shaped bar near the second fork-receiving hook 204 to provide structural reinforcement to the H-shaped bar 200. In the illustrated embodiment, the reinforcement bar 150 is vertically offset relative to the H-shaped bar 200, as shown in FIG. 4B. Because the reinforcement bar 150 is vertically offset relative to the H-shaped bar 200, a first fillet weld (not shown in FIG. 4B; similar to a first fillet weld 60 shown in FIG. 5) can be formed between a side surface 150C of the reinforcement bar 150 and an upper corner 200C of the H-shaped bar 200. Further, a second fillet weld (not shown in FIG. 4B; similar to a second fillet weld 62 in FIG. 5) can be formed between a bottom surface 150B of the reinforcement bar 150 and a lower side surface 200D and/or a lower corner 200E of the H-shaped bar 200, as seen in FIG. 4B. The H-shaped bar 200 is also welded to the fork carriage first and second members 30A and 30B via fillet and groove welds (not shown).

In the second embodiment illustrated in FIG. 4B, the reinforcement bar 150 has a height $H_{150}$ equal to about 63 mm and a width $W_{150}$ equal to about 10 mm. In an alternative embodiment, the width $W_{150}$ is equal to 13 mm. The reinforcement bar 150 has a width $W_{150}$ greater than that of the width $W_{50}$ of the reinforcement bar 50 of the first embodiment shown in FIG. 4A, and hence, the reinforcement bar 150 of the second embodiment is larger than the reinforcement bar 50 of the first embodiment. The larger reinforcement bar 150 allows the fork carriage 130 and its upper member 130C to support a larger load, e.g., up to 5500 pounds in the illustrated embodiment, than the upper member 30C of the first embodiment. The reinforcement bar 150 spans generally the entire length of the H-shaped bar 200 in the illustrated embodiment.

Further during manufacturing, a plurality of notches 202A are machined into the first fork-receiving hook 202 to receiving corresponding mating structure (not shown) on the forks 140A and 140B.

A protection shield 30F is welded to the H-shaped bar 200 and the fork carriage first and second side members 30A and 30B, so as to provide protection for the rams 120 and 122 of the lifting carriage upper member 20C, which rams 120 and 122 are positioned behind the protection shield 30F, and to increase the overall strength of the fork carriage upper member 130C.

A fork carriage 230 constructed in accordance with a third embodiment of the present invention, is illustrated in FIG. 4C and comprises a fork carriage upper member 230C. The fork carriage 230 further includes first and second vertical members 30A and 30B and a lower member 30D, which are substantially the same as like elements used in the construction of the fork carriage 30 in accordance with a first embodiment shown in FIG. 4A.

The fork carriage upper member 230C, constructed in accordance with the third embodiment of the present invention, comprises a fork-supporting bar, which, in the embodiment illustrated in FIG. 4C, comprises the same H-shaped bar 200 used in the fork carriage upper members 30C and 130C in accordance with first and second embodiments shown in FIGS. 4A and 4B, respectively. However, to allow the fork carriage 230 and its upper member 230C to support forks larger than the forks 140A, 142A shown in FIG. 6 and supported by the upper members 30C and 130C, the H-shaped bar in FIG. 4C has been rotated 180 degrees so that the second fork-receiving hook 204 is positioned outwardly away from the mast assembly, to allow the larger forks, e.g., Class 3 forks, to be mounted on the second fork-receiving hook 204. The forks adapted to be mounted on the second fork-receiving hook 204 may comprise Class 3 forks having a fork load supporting capacity of from about 5500 pounds to about 10,000 pounds (ISO Class 3 2501-4999 kg).

A reinforcement bar 250 is welded to the H-shaped bar 200 and positioned adjacent to a side of the H-shaped bar near the first fork-receiving hook 202 to provide structural reinforcement to the H-shaped bar 200. In the embodiment illustrated in FIG. 4C, the reinforcement bar 250 is vertically offset relative to the H-shaped bar 200. Because the reinforcement bar 250 is vertically offset relative to the H-shaped bar 200, a first fillet weld (not shown in FIG. 4C; similar to a first fillet weld 60 shown in FIG. 5) can be formed between a side surface 250C of the reinforcement bar 150 and an upper corner 200F of the H-shaped bar 200. Further, a second fillet weld (not shown in FIG. 4C; similar to a second fillet weld 62 shown in FIG. 5) can be formed between a bottom surface 250B of the reinforcement bar 250 and a lower side surface 200G and/or a corner 200H of the H-shaped bar 200, as seen in FIG. 4C. The H-shaped bar 200 is also welded to the fork carriage first and second members 30A and 30B via fillet and groove welds.

In the embodiment illustrated in FIG. 4C, the reinforcement bar 250 has a height $H_{250}$ equal to about 63 mm and a width $W_{250}$ equal to about 19 mm. The reinforcement bar 250 has a width $W_{250}$ greater than that of the width $W_{150}$ of the reinforcement bar 150 of the second embodiment shown in FIG. 4B and the width $W_{50}$ of the reinforcement bar 50 of the first embodiment shown in FIG. 4A. Hence, the reinforcement bar 250 is larger than the reinforcement bar 150 of the second embodiment and the reinforcement bar 50 of the first embodiment. The larger reinforcement bar 250 and the larger hook 204 allows the fork carriage 250 and its upper member 230C to support larger forks and a greater load, e.g., up to 6500 pounds in the illustrated embodiment, than the upper members 30C and 130C of the first and second embodiments. The reinforcement bar 250 spans generally the entire length of the H-shaped bar 200 in the illustrated embodiment.

Further during manufacturing, a plurality of notches 204A are machined into the second fork-receiving hook 204 to receiving corresponding mating structure (not shown) on forks to be mounted to the second fork-receiving hook 204.

A protection shield 30F is welded to the H-shaped bar 200 and the fork carriage first and second side members 30A and 30B, so as to provide protection for the rams 120 and 122 of the lifting carriage upper member 20C, which rams 120 and 122 are positioned behind the protection shield 30F.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of manufacturing a fork carriage comprising:

providing a fork-supporting bar having first and second fork-receiving hooks, wherein the second fork-receiving hook is of a larger size in cross-section than the first fork-receiving hook taken in a vertical cross-section through both the first and second fork-receiving hooks perpendicular to a lateral direction on the fork-supporting bar;

based on a size of one or more forks desired to be mounted on the fork-supporting bar, positioning the fork-supporting bar such that one of the first and second fork-receiving hooks corresponding to the size of the one or more forks is located outwardly to receive the one or more forks on the one fork-receiving hook; and immovably fixing a laterally extending reinforcement bar to a first side of the fork-supporting bar opposite a second side of the fork-supporting bar near the one fork-receiving hook.

2. The method as set forth in claim 1, further comprising selecting a size of the reinforcement bar based on a desired amount of weight to be supported by the one or more forks.

3. The method as set forth in claim 1, wherein the fork-supporting bar comprises an H-shaped bar in cross-section taken in a vertical cross-section through both the first and second fork-receiving hooks perpendicular to a lateral direction on the fork-supporting bar.

4. The method as set forth in claim 1, wherein coupling the reinforcement bar to the fork-supporting bar comprises welding the reinforcement bar to the first side of the fork-supporting bar opposite the second side near the one fork-receiving hook.

5. The method as set forth in claim 1, wherein the reinforcement bar has upper and bottom laterally extending surfaces, and the reinforcement bar is vertically offset relative to the fork-supporting bar such that the upper and bottom surfaces of the reinforcement bar are vertically offset relative to upper and lower surfaces of the fork-supporting bar.

6. The method as set forth in claim 5, wherein coupling the reinforcement bar to the fork-supporting bar comprises making a first fillet weld between a laterally extending side surface of the reinforcement bar and a laterally extending upper corner adjacent the upper surface of the fork-supporting bar.

7. The method as set forth in claim 6, wherein coupling the reinforcement bar to the fork-supporting bar further comprises making a second fillet weld between the bottom surface of the reinforcement bar and a lower side surface and a lower corner of the fork-supporting bar adjacent the lower surface of the fork-supporting bar.

8. The method as set forth in claim 7, wherein the reinforcement bar spans generally an entire length of the fork-supporting bar.

9. The method as set forth in claim 1, further comprising machining notches in the one fork-receiving hook.

10. The method as set forth in claim 1, including laterally spaced first and second vertical members and coupling the fork-supporting bar to the first and second vertical members.

11. The method as set forth in claim 1, wherein the fork-supporting bar includes a laterally extending inner cavity formed in a lower surface of the fork-supporting bar between the first and second fork-receiving hooks, and the inner cavity defines a surface for engaging on a laterally extending surface of a lifting carriage member.

12. A method of manufacturing a fork carriage comprising:

providing a fork-supporting bar having first and second fork-receiving hooks, wherein the second fork-receiving hook is of a larger size in cross-section than the first fork-receiving hook taken in a vertical cross-section through both the first and second fork-receiving hooks perpendicular to a lateral direction on the fork-supporting bar;

based on a size of one or more forks desired to be mounted on the fork-supporting bar, positioning the fork-supporting bar such that one of the first and second fork-receiving hooks corresponding to the size of the one or more forks is located outwardly to receive the one or more forks on the one fork-receiving hook; and immovably fixing a laterally extending reinforcement bar to a first side of the fork-supporting bar opposite a second side of the fork-supporting bar near the one fork-receiving hook, wherein the first side of the fork-supporting bar comprising a side of the other fork-receiving hook.

13. A method of manufacturing a fork carriage comprising:

providing a fork-supporting bar having first and second fork-receiving hooks, wherein the second fork-receiving hook is of a larger size in cross-section than the first fork-receiving hook taken in a vertical cross-section through both the first and second fork-receiving hooks perpendicular to a lateral direction on the fork-supporting bar;

based on a size of one or more forks desired to be mounted on the fork-supporting bar, positioning the fork-supporting bar such that one of the first and second fork-receiving hooks corresponding to the size of the one or more forks is located outwardly to receive the one or more forks on the one fork-receiving hook; and coupling a laterally extending reinforcement bar to a first side of the fork-supporting bar opposite a second side of the fork-supporting bar near the one fork-receiving hook;

wherein the reinforcement bar has upper and bottom laterally extending surfaces, and the reinforcement bar is vertically offset relative to the fork-supporting bar such that the upper and bottom surfaces of the reinforcement bar are vertically offset relative to upper and lower surfaces of the fork-supporting bar, and wherein coupling the reinforcement bar to the fork-supporting bar comprises making a first fillet weld between a laterally extending side surface of the reinforcement bar and a laterally extending upper corner adjacent the upper surface of the fork-supporting bar, and further comprises making a second fillet weld between the bottom surface of the reinforcement bar and a lower side surface and a lower corner of the fork-supporting bar adjacent the lower surface of the fork-supporting bar.

* * * * *